US005479071A

United States Patent [19]

Lynn

[11] Patent Number: 5,479,071

[45] Date of Patent: Dec. 26, 1995

[54] FLAT FORM DEVICE FOR CREATING ILLUMINATED PATTERNS

[75] Inventor: Judd B. Lynn, Colorado Springs, Colo.

[73] Assignee: Flat Candle Company, Colorado Springs, Colo.

[21] Appl. No.: 56,191

[22] Filed: May 3, 1993

[51] Int. Cl.[6] ..... H01J 17/20

[52] U.S. Cl. ..... 313/514; 313/515

[58] Field of Search ..... 313/514, 515, 313/516, 517, 513, 485, 491; 362/812; 40/552

[56] References Cited

U.S. PATENT DOCUMENTS

| | | | |
|---|---|---|---|
| 1,697,501 | 1/1929 | Gast | 313/514 |
| 1,820,913 | 9/1931 | Kelly et al. | 40/552 |
| 1,904,850 | 4/1933 | Boyce et al. | 40/552 |
| 2,102,049 | 12/1937 | Warren . | |
| 3,755,943 | 9/1973 | Cesarotti | 40/552 |
| 3,965,597 | 6/1976 | Noellert | 40/552 |
| 3,973,164 | 8/1976 | Nolan et al. | 313/518 |
| 3,978,599 | 9/1976 | Berger | 40/552 |
| 4,872,741 | 10/1989 | Dakin et al. | 313/491 |
| 5,036,243 | 7/1991 | Cocks et al. | 313/515 |

FOREIGN PATENT DOCUMENTS

| | | | |
|---|---|---|---|
| 1107314 | 3/1968 | United Kingdom | 40/552 |

*Primary Examiner*—Sandra L. O'Shea
*Assistant Examiner*—Vip Patel
*Attorney, Agent, or Firm*—Flehr, Hohbach, Test, Albritton & Herbert

[57] ABSTRACT

A flat form graphic device for displaying light in patterns of different graphic shapes. The device includes glass plates which are bonded together with at least one of the plates molded with a shaped portion extending over the area of the desired shape. A cavity formed between the shaped portion and the other plate is charged with an ionizable gaseous medium, and the inner surfaces of the cavity are coated with phosphors. In one embodiment electrodes are activated for producing a gas discharge within the cavity generate fluorescent light. In another embodiment, emf radiators are mounted on the device and the radiators are operated by a control system for producing an emf field which excites the ionizable medium to generate the light. In another embodiment shields are provided for shielding out undesirable emf radiation and also for directing or otherwise influencing the illumination pattern.

2 Claims, 5 Drawing Sheets

FLAT FORM DEVICE FOR CREATING ILLUMINATED PATTERNS

BACKGROUND OF THE INVENTION

1. Field of the Invention

This invention relates in general to gas discharge lighting devices of flat form configuration. More particularly, the invention relates to the construction and method of operation of gas discharge lighting devices made in flat glass envelopes to produce illuminated graphic patterns in signs, architectural lighting or other graphic displays.

2. Description of the Prior Art

Lighted signs of Neon or Mercury vapor UV discharge phosphor coated types are in common use. The predominant construction of this type of lighted signs is through the use of bent tubing. In U.S. Pat. No. 2,102,049 to Warren, a method of constructing Neon signs using molded glass in flat arrays is described.

The Neon tube sign is well applied to large signs or architectural lighting. For small, detailed graphic signs, tubing has the disadvantage of limiting the graphic design because of the constant diameter tubes, because it is very difficult to get multi-colored patterns in one discharge path, and because the cost to make many signs of the same design is very expensive.

In the Warren U.S. Pat. No. 2,102,049, only the use of Neon or other colored gases is discussed. Also, the envelope construction in that patent only includes channels of constant width and uniform height, and requires a continuous discharge path from one end electrode to the other end electrode. All of this limits the graphic possibilities for this type of sign construction.

The prior art also includes flat envelope graphic signs that are made from thick glass plates. The plates have channels created by removing glass abrasively or by other methods, and a flat glass plate is then fused to the channel plate. Signs of this construction can have various width discharge channels, but the viewing surface of the sign is flat and there is no possibility for contour or surface texture, which are important aesthetic factors in graphic and sign design.

OBJECTS AND SUMMARY OF THE INVENTION

It is a general object of the invention to provide a new and improved gas discharge graphic device of flat form construction.

Another object is to provide a flat form graphic device of the type described which displays light in various predetermined patterns of graphic shapes or alpha-numeric characters or ideographic symbols.

Another object is to provide a flat form graphic device of the type described which can be adapted to use gas discharge or phosphor emission lighting.

Another object is to provide a flat form graphic device of the type described which uses high frequency emf fields for exciting an ionizable medium to produce light.

Another object is to provide a flat form graphic device of the type described having a control system incorporating emf radiators which produce predetermined patterns of emf fields for exciting an ionizable medium to produce light patterns.

Another object is to provide a flat form graphic device of the type described which includes means for directing or constraining emf fields to control the light pattern from an ionizable medium that is affected by the field.

The invention in summary provides a flat form graphic device and method of operation for displaying light in a predetermined pattern of graphic shapes or alpha-numeric characters or ideographic symbols. The device is comprised of a first plate which is formed with at least one shaped portion that defines the desired graphic shape, character or symbol. A second plate is mounted in juxtaposed relationship with the first plate so that a cavity is formed below the shaped portion. The cavity is charged with an ionizable gaseous medium which is capable of being excited into an electric discharge which causes light to be emitted through light-transmissive portions of the device. Control means is provided for exciting the ionizable gaseous medium to produce the light. In one embodiment the control means includes electrodes mounted in the cavity, and in another embodiment emf radiators are provided in the device for producing high frequency emf fields for exciting the ionizable medium. In certain embodiments the emf field is directed in predetermined patterns either by orienting the radiators in a predetermined array relative to the plates, or by patterns of conductors which are arranged to shunt, isolate, direct or shield portions of the emf field.

The foregoing and additional objects and features of the invention will appear from the following specification in which the several embodiments have been set forth in detail in conjunction with the accompanying drawings.

DESCRIPTION OF THE PREFERRED EMBODIMENTS

Figure 1:
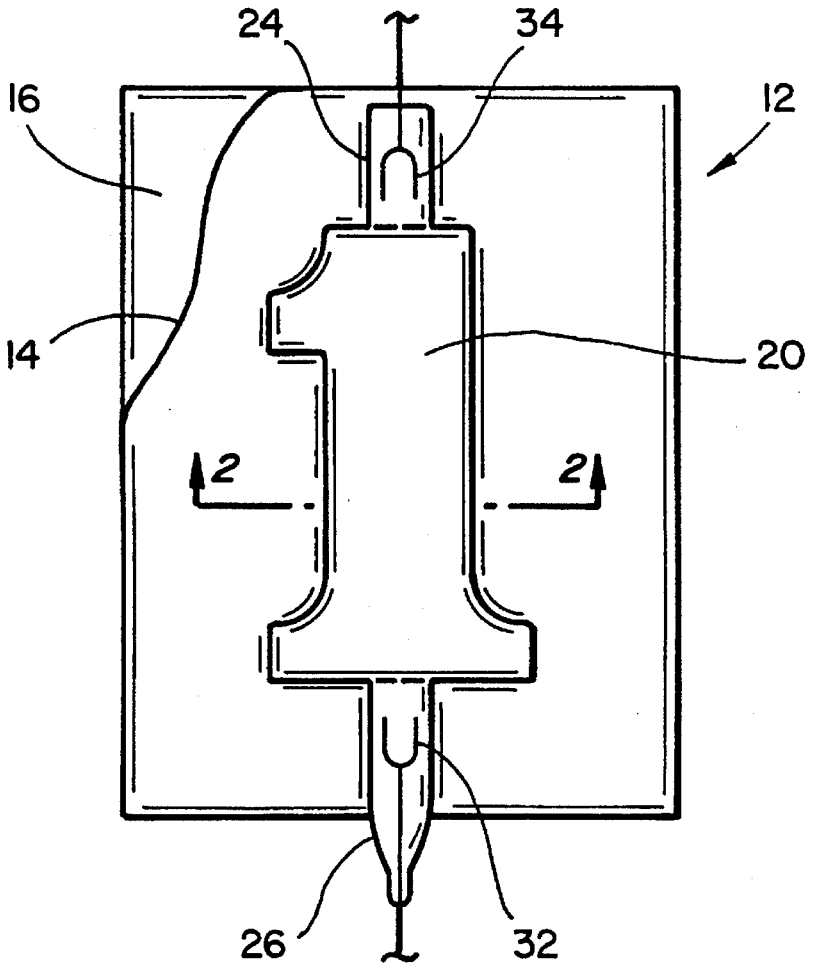
FIG. 1 is a top plan view of a flat form graphic device according to one embodiment of the invention.
Figure 2:
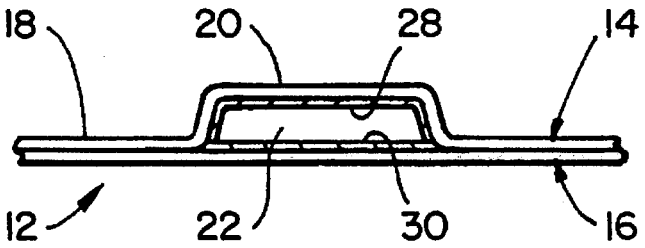
FIG. 2 is a fragmentary cross sectional view taken along the line 2—2 of FIG. 1.

Referring to the drawings, FIGS. 1 and 2 illustrate one preferred embodiment of the invention providing a flat form graphic device 12 for creating illuminated patterns. Device 12 is comprised of a first plate 14 molded to form the desired graphic pattern and which is mounted above a second plate 16. The first and second plates are formed of a suitable transparent or translucent material such as clear glass or other vitreous material.

First plate 14 is molded with a planar base portion 18 and a shaped portion 20 which projects forward from the plane of the base portion. The shaped portion is molded to form the desired graphic pattern, which can be alpha-numeric characters, ideographic symbols or other graphic shapes, as required by the particular application. In the illustrated example, shaped portion 20 is molded to form the alphanumeric character for the number one.

The inner surface of shaped portion 20 and base portion 18 are spaced apart to define a channel or cavity 22. The planar base portion 18 of the first plate is mounted by suitable means such as glass frit seal or glass welding across the facing upper surface of the second plate about the perimeter of the shaped portion to hermetically seal the cavity. The first plate is also formed with raised pockets 24, 26 at opposite ends of the shaped portion for placement of electrodes. The pockets communicate with cavity 22 and are also hermetically sealed. The cavity is exhausted to a partial vacuum by a suitable exhaust tube, not shown, or other means.

In the illustrated embodiment, cavity 22 is of uniform depth, although the depth of the cavity could be varied in accordance with the particular application. Wall thickness of the first and second plates can be in the range 0.02" to 0.06". The total thickness of the combined front plate, cavity and back plate can be in the range of 0.15" to 0.50". While in this embodiment the first plate, which is the front plate, is molded with the shaped portion, the invention contemplates that the rear plate could be molded with the shaped portion while the front plate is flat, or both front and rear plates could be formed with shaped portions. In this manner, the desired viewing surface contour can be achieved.

During fabrication the inner surface of first plate 14 is coated with a layer 28 of phosphors of the type that absorb ultraviolet radiation and reradiate at wave lengths visible to the human eye. Another layer 30 of phosphors can be coated on the inner surface of second plate 16. An activated powdered phosphor such as magnesium tungstate or calcium Fluorochlorophosphate:Antimony:Manganese is suitable for this purpose. As desired, a suitable reflector layer, not shown, may be provided under phosphor layer 30 and over the inner surface of the second or rear plate to increase brightness. The phosphors and reflector material can be deposited by spraying, screen printing or other suitable methods. The deposition of the phosphor layer, as well as the reflector layer where it is used, preferably is in the pattern which coordinates with the shaped portion molded in the glass. The phosphors can be selected in accordance with the light which they emit, and a single color phosphor can be used as well as a combination of different phosphors to provide multiple colors.

After evacuation, cavity 22 is filled with a low pressure ionizable medium which carries electrical current. The ionizable medium can comprise an inert gas such as Argon which is charged with a small percentage of Mercury vapor to provide a fluorescent gas mixture. The ionizable medium could also comprise Neon gas or a Penning mixture such as a mixture of Neon and Argon gases or a mixture of Neon and Xenon gases. Gas pressure within the cavity preferably is within the range of three to thirty torr.

The ionizable gaseous medium within the cavity is excited into an electric discharge by a suitable control circuit, not shown, applying a voltage potential across electrodes 32 and 34. The control circuit can apply either a direct current or alternating current to the electrodes. The excited gas gives off photons of energy, and the partial pressure of the Mercury vapor is particularly rich in radiating UV photons. The phosphor coatings absorb the UV radiation and reradiate visible light which is emitted through the transparent shaped portion 20 to produce the lighted pattern. Where the cavity is filled with an ionizable medium comprising Neon or a mixture of Neon and other inert gas, the current flow causes the Neon to itself emit a reddish-orange light.

Figure 3:
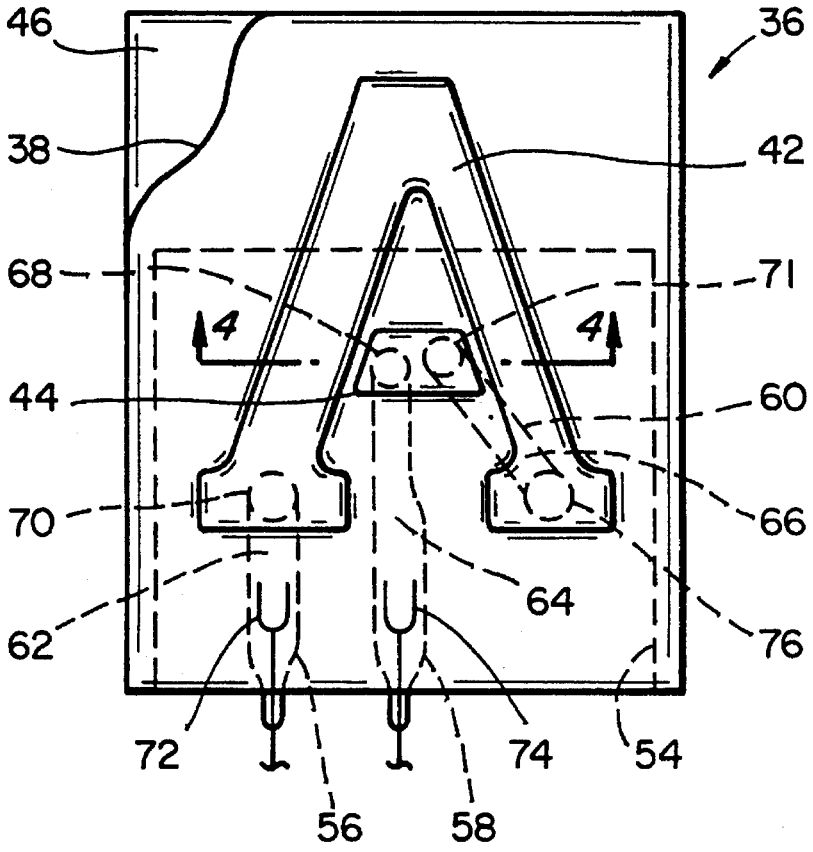
FIG. 3 is a top plan view of a flat form graphic device according to another embodiment of the invention.
Figure 4:
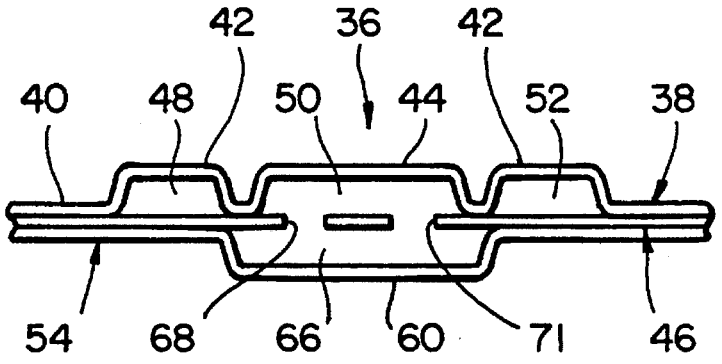
FIG. 4 is a fragmentary cross sectional view taken along the line 4—4 of FIG. 3.

FIGS. 3 and 4 illustrate another embodiment providing a flat form graphic device 36. Device 36 is comprised of a first plate 38 having a base portion 40 and a plurality of shaped portions 42, 44 which are molded to form the letter "A." The first plate is mounted on the front surface of a planar second plate 46, with the base of the first plate hermetically sealed to the underlying portions of the second plate. The outer walls of the shaped portions are spaced in front of the second plate to define subcavities 48, 50 and 52 which form portions of the graphic pattern. In the illustrated embodiment, the two shaped portions which define subcavities 48 and 52 form the opposite legs of the letter "A." The raised portion which forms the subcavity 50 forms the crossbar of the "A" letter, and the crossbar is spaced apart from the subcavities which form the legs.

A third glass plate 54 is mounted against and hermetically sealed with the rear surface of the second plate. The third plate is molded with a plurality of shaped portions 56, 58 and 60. The shaped portions of the third plate are spaced rearwardly from the second plate to define channels 62, 64 and 66. Channel 66 extends below subcavity 50 which forms the crossbar of the "A" letter. Holes 68 and 71 are formed in second plate 46 for communicating gas between channel 66 and subcavity 50. Channels 62 and 64 contain electrodes 72, 74 which are connected with a suitable control system, not shown. Channel 60 provides gas communication with subcavity 50 of the crossbar through a hole 76 which is formed in second plate 46 at the location below the serif at the lower end of one leg of the letter "A." Channel 62 extends below hole 70 formed in the second plate at a location below the serif at the lower end of the other leg of the "A" letter. The channels formed in the third plate, together with the holes formed in the second plate, form interconnect paths to provide a continuous gas discharge path between the electrodes along the length of the shaped portions of the first plate. Light which is emitted from the channels and pockets in the third plate would not be visible from the front of the graphic device. The third plate with its channels forming the interconnect paths provides the capability of achieving complex graphic shapes.

The inner surfaces of portions of either both of the first and second plates of the subcavities which form the graphic pattern are coated with suitable phosphors, and the cavities are evacuated and charged with the desired ionizable gaseous medium. The control circuit is connected with the electrodes and operated in the manner described above for exciting the gaseous medium into an electric discharge which produces the graphic pattern of light.

The invention also contemplates that a single graphic device could be fabricated with shaped portions forming a graphic pattern having a plurality of separate gas discharge paths. Independent electrode pairs would be provided in the cavities of each separate gas discharge path, and the control circuit would include means for selectively activating the electrode pairs to light different areas of the graphic display according to the discharge path design.

Figure 5:
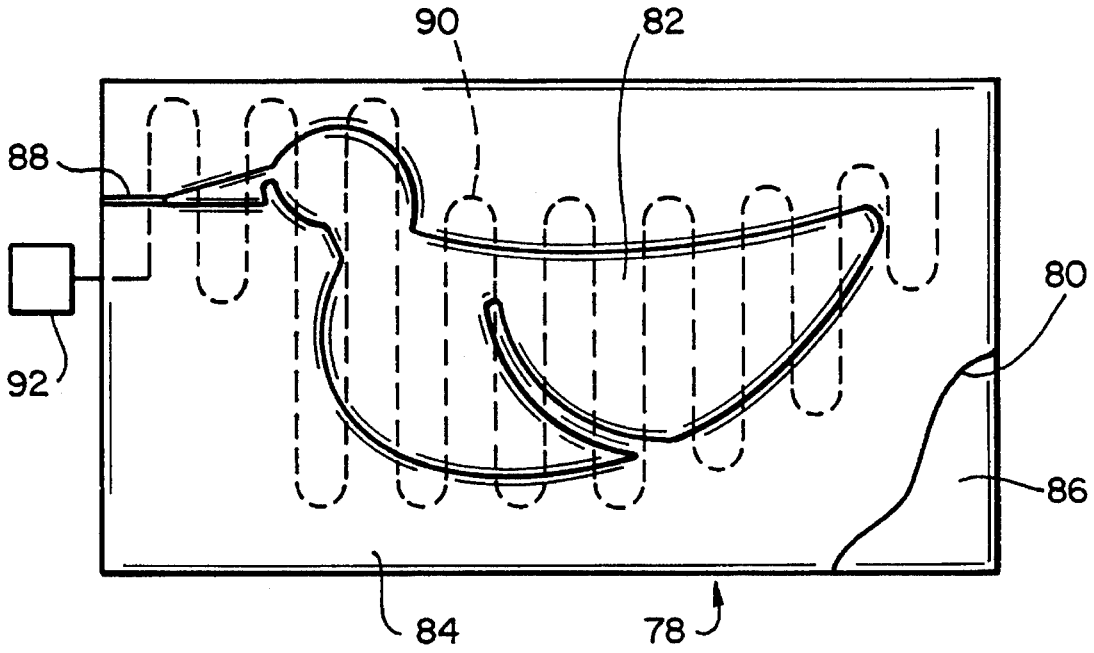
FIG. 5 is a top plan view of a flat form graphic device according to another embodiment of the invention.
Figure 6:
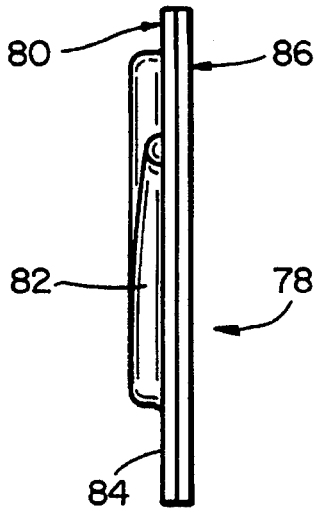
FIG. 6 is an end view of the graphic device of FIG. 5.

FIGS. 5 and 6 illustrate another embodiment providing a flat form graphic device 78 utilizing emf radiation for exciting the ionizable gaseous medium. Graphic device 78 is comprised of a first plate 80 molded with a shaped portion 82 in the manner described for the embodiment of FIGS. 1–2 to form an internal, hermetically sealed cavity. In the illustrated embodiment, the graphic pattern of the shaped portion is in the outline of a duck. The first glass plate includes a planar base portion 84 which is bonded to the surface of a flat second glass plate 86. An exhaust tube 88 is formed at one side of the first plate and is in communication with raised portion 82 for exhausting the cavity to a partial vacuum as well as for charging the cavity with a suitable ionizable medium in the manner described above for the embodiment of FIGS. 1–2. Either or both of the inner surfaces of the portions of the first and second plates which define the cavity are coated with suitable phosphors.

This embodiment includes means for exciting the ionizable gaseous medium by applying a high frequency emf field to the cavity. This method of excitation not only eliminates the need for electrodes but also makes it possible to activate and illuminate complex graphic patterns that would be difficult to excite and illuminate with conventional electrode gas discharge. The graphic pattern of the duck shown in FIG. 5 is an example of such a pattern that would be difficult to illuminate using electrodes.

The means for applying the high frequency emf field is comprised an emf antenna or radiator 90 which is connected at one end with a high frequency transmitter 92. Transmitter 92 is tuned to produce a high frequency signal, preferably in the range of 10 Khz to 13.56 Mhz. The power delivered to the radiator can be from approximately 1 watt up to 40 watts or more, depending upon the total area to be lighted by the radiator array and also depending upon the desired amount of luminance. In the illustrated embodiment, radiator 90 is comprised of a length of wire coiled into an array which substantially overlies the graphic pattern. The emf radiator is mounted across the device by being secured to either of the first or second plates. The radiator wire can advantageously be printed to the inner surface of second plate so that with the first plate then mounted in place, the radiator is sandwiched between two plates. The invention also contemplates that the radiator can be installed on the exterior of either of the first or second plates. The radiator can also comprise a strip of metal foil mounted to the glass surface.

Figure 7:
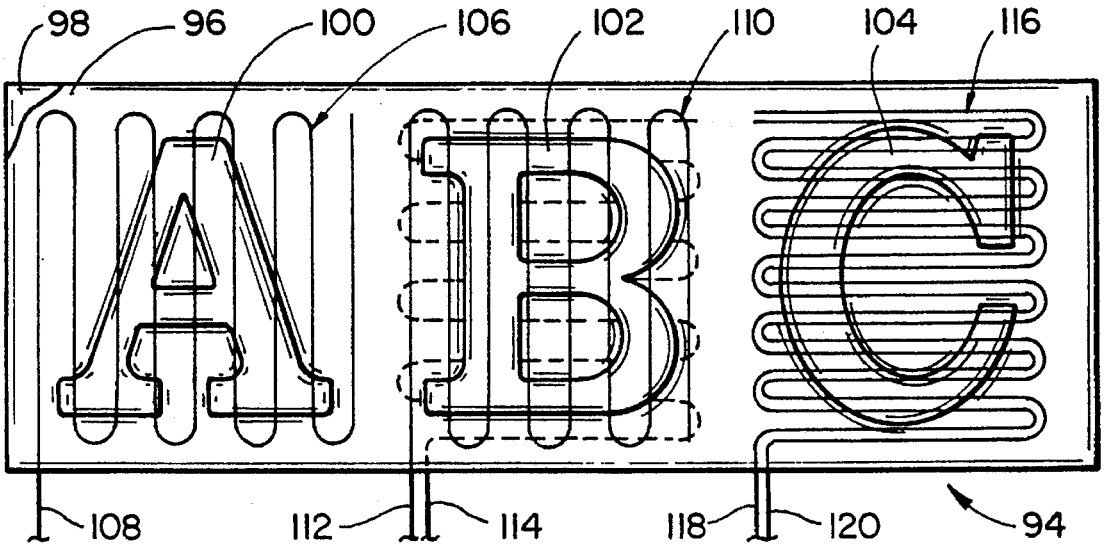
FIG. 7 is a top plan view of a flat form graphic device according to yet another embodiment of the invention.
Figure 8:
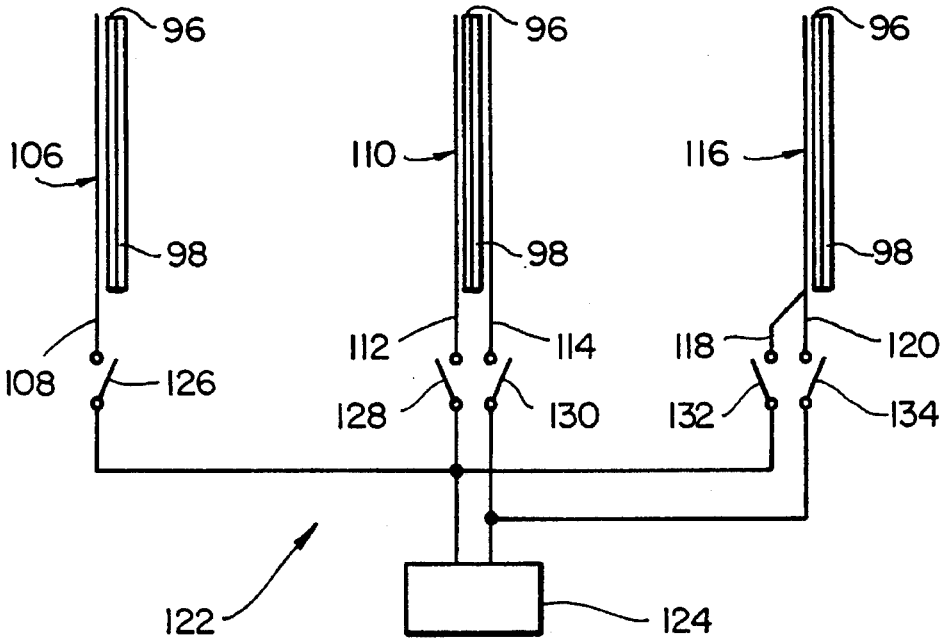
FIG. 8 is a schematic diagram illustrating the system of control of the emf radiators for the embodiment of FIG. 7.

FIGS. 7 and 8 illustrate another embodiment providing a flat form graphic device 94 which also employs high frequency emf energy for operation. Device 94 comprises an envelope formed of front and rear glass plates 96, 98 bonded together in the manner described for the embodiment of FIGS. 5 and 6. The front plate is molded with three shaped portions 100, 102 and 104 having the desired graphic patterns. FIG. 7 illustrates typical patterns in which shaped portion 100 forms the letter "A," shaped portion 102 forms the letter "B" and shaped portion 104 forms the letter "C." Hermetically sealed cavities formed by the shaped portions are evacuated and charged with the desired ionizable gaseous medium.

Three different emf radiator arrays are shown for exciting the ionizable medium within the different cavities. Radiator array 106 is comprised of a wire or foil coil 108 which is printed or otherwise mounted on the outer surface of front plate 96. As desired, the coil could be mounted on the outer surface of the rear plate. The area covered by the coil substantially extends over the cavity which forms the letter "A."

Another emf radiator array 110 is provided for exciting the ionizable medium within the cavity which forms the letter "B." Array 110 is comprised of a first wire or foil coil 112 which is mounted on the outer surface of front plate 96, together with a second wire or foil coil 114 which is mounted on the outer surface of the rear plate. The long axes of parallel segments of the two coils are mounted orthogonal to each other to increase uniformity of emf radiation to the cavity.

A third emf radiator array 116 is provided for exciting the ionizable medium within the cavity which forms the letter "C." This array is comprised of a pair of wire or foil coils 118, 120 which are interlaced together in parallel spaced relationship across the area covering the letter "C." This configuration also increases the uniformity of emf radiation to the cavity. As desired, the interlaced coils could be mounted on the outer surface of the rear glass plate.

One end of each wire coil 106, 110 and 116 projects from the envelope for connection with the control system 122 of FIG. 8. Control system 122 is comprised of a high frequency emf energy source or transmitter 124 similar to that described for the embodiment of FIGS. 5–6. The emf transmitter is connected through on-off switch 126 with wire coil 108 of radiator array 106 for activating the illumination of the letter "A," through a pair of switches 128, 130 with the wire coils 112, 114 of radiator array 110 for activating the illumination of the letter "B," and through the pair of switches 132, 134 with wire coils 118, 120 of radiator array 116 for activating the illumination of the letter "C." A suitable switch control, not shown, could be provided for operating the switches in a predetermined program for coordinating illumination of the letters together or in any desired sequence.

Figure 9:
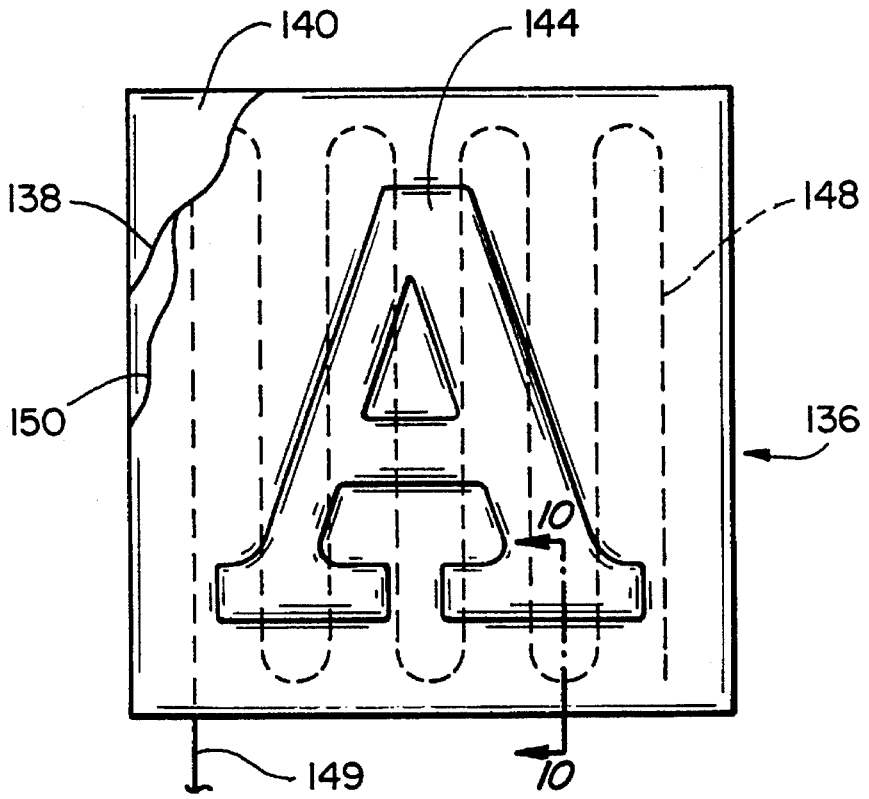
FIG. 9 is a top plan view of another embodiment of the invention.
Figure 10:
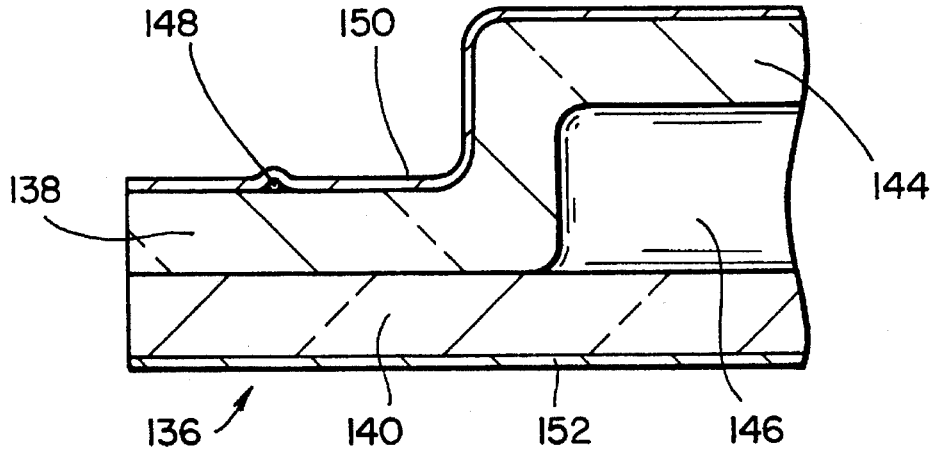
FIG. 10 is a cross sectional view to an enlarged scale taken along the line 10—10 of FIG. 9.

The embodiment illustrated in FIGS. 9–10 provides another flat form graphic device 136. Device 136 is comprised of front and rear glass plates 138, 140 which are mounted together in the manner described in connection with FIGS. 5–6. Front plate is molded with a shaped portion 144 which forms the desired graphic pattern, shown as the letter "A" in this example. The cavity 146 formed by the shaped portion is evacuated and charged with the desired ionizable gaseous medium in the manner explained in connection with the embodiment of FIGS. 5–6. An emf radiator formed in a wire or foil coil 148 is mounted on the outer surface of front plate 138. One end 149 of the coil is connected with a suitable high frequency emf source, not shown, for producing the emf field which excites the ionizable medium.

An emf field shield 150 is formed over the outer surface of the front plate and over emf radiator coil 148. The shield is electrically insulated by suitable means from the radiator coil. Shield 150 is formed of a transparent electric conductor deposited over the outer surface of the glass. Suitable transparent conductors appropriate for depositing on the glass includes Indium Tin oxide (ITO), Tin oxide or gold in thin film form. The material of the shield can be formed by means such as spraying, chemical deposition or vapor deposition. For optimum frontal shielding of undesired emf radiation, shield 150 is deposited in a continuous film across the outer surface of the front plate. Another layer 152 of transparent or opaque conductor material, such as the ITO, Tin oxide, thin film gold, or opaque foil or conductive coating, is deposited on the outer surface of the back plate to serve as a ground shield.

The shields 150 and 152 can be configured in different patterns to direct, shunt, isolate, reflect or otherwise influence the illumination pattern by influencing the emf field. For this purpose, either or both of the shields could be formed in perforated, grid, striped or other geometric patterns, depending upon the desired illumination effect, such as contour or surface texture of the illuminated patterns. The shield or shields could also be mounted internally within the cavity, or they could be mounted externally and separate from the device for influencing the emf field. It is recognized that the excitation effect on the gas-filled envelope can be combinations of electromotive force, capacitive coupling and inductive coupling. It is also recognized that the coupling of these forces can be selectively enhanced or inhibited with the use of passive or active circuits placed on the envelope body.

It is apparent that applicant has provided a new and improved graphic device for displaying lights in a variety of graphic shapes. In the embodiments in which the ionizable medium is excited by emf energy, the need for electrodes is eliminated so that the life of the sign or lamp is greatly extended. In the sign or lamp configuration of the invention employing emf energy, random patterns can be lighted without regard to maintaining a continuous discharge pathway.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. A flat form graphic device for displaying light in a pattern of graphic shapes, alpha-numeric characters or ideographic symbols, the device comprising the combination of a first plate, said first plate being shaped with a base portion extending along a given plane together with at least one shaped portion which extends over an area having a predetermined graphic, alpha-numeric or ideographic symbol shape, said base portion and shaped portions each having inner surfaces, said shaped portion further being light-transmissive along selected areas thereof said shaped portion being shaped to project in a first direction from said given plane with the shaped portion defining a predetermined graphic pattern, a second plate having a planar surface, means for mounting the second plate with its planar surface extending along the first plate in juxtaposed relationship with at least certain portions of the inner surface of said base portion with at least one cavity being formed between said inner surface of the shaped portion and a portion of said planar surface of the second plate, means tier filling said cavity with an ionizable gaseous medium which is capable of being excited into an electric discharge for radiating light through said selected areas of the shaped portion, means for exciting said ionizable gaseous medium for causing light to be produced within and emitted from the cavity, and a light-transmitting, electrically-conductive coating means on a predetermined area of said shaped portion for shielding undesirable portions of emf energy being radiated from the cavity.

2. A graphic device as in claim 1 in which said coating is arrayed in a predetermined pattern on said outer surface for selectively controlling the pattern of emf energy being radiated by the emf radiating means.

* * * * *